US007407309B2

(12) United States Patent
Scholz

(10) Patent No.: US 7,407,309 B2
(45) Date of Patent: Aug. 5, 2008

(54) MEDICAL LAMP

(75) Inventor: Manfred Scholz, Seitingen-Oberflacht (DE)

(73) Assignee: Berchtold Holding GmbH, Tuttlingen (DE)

( * ) Notice: Subject to any disclaimer, the term of this patent is extended or adjusted under 35 U.S.C. 154(b) by 0 days.

(21) Appl. No.: 11/691,675

(22) Filed: Mar. 27, 2007

(65) Prior Publication Data

US 2007/0242447 A1 Oct. 18, 2007

(30) Foreign Application Priority Data

Mar. 27, 2006 (DE) ..... 10 2006 014 003

(51) Int. Cl.
*F21V 29/00* (2006.01)

(52) U.S. Cl. ..... 362/373; 362/33; 362/804

(58) Field of Classification Search ..... 362/33, 362/96, 264, 294, 373, 804, 267, 362
See application file for complete search history.

(56) References Cited

U.S. PATENT DOCUMENTS 2,827,554 A 3/1958 Gunther et al.
3,348,036 A * 10/1967 Bodian et al. ..... 362/373
4,578,742 A 3/1986 Klein et al.
4,600,979 A 7/1986 Fisher et al.
4,651,257 A 3/1987 Gehly
4,930,054 A * 5/1990 Krebs ..... 362/294
5,921,663 A * 7/1999 Flammer ..... 362/294
7,021,793 B2 * 4/2006 Biasoli et al. ..... 362/267
7,275,848 B2 * 10/2007 Chinniah et al. ..... 362/373

FOREIGN PATENT DOCUMENTS

DE 19 70 078 U 10/1967
DE 299 06 721 U1 8/1999

OTHER PUBLICATIONS

Translation of the German Search Report relating to Application No. 10 2006 014 003.6, dated Novembre 30, 2006, 5 pages.
German Search Report relating to Application No. 10 2006 014 003.6, dated Novembre 30, 2006, 4 pages.

* cited by examiner

*Primary Examiner*—Y M. Lee
(74) *Attorney, Agent, or Firm*—Lewis and Roca LLP

(57) ABSTRACT

A medical lamp has a closed housing having a front side, a rear side and a peripheral side connecting the front side and the rear side. A light source and a reflector are provided in the housing and means are provided to reduce the heat dissipation to the outside from the rear side of the housing.

7 Claims, 1 Drawing Sheet

MEDICAL LAMP

CROSS-REFERENCE TO RELATED APPLICATIONS

Figure 1:
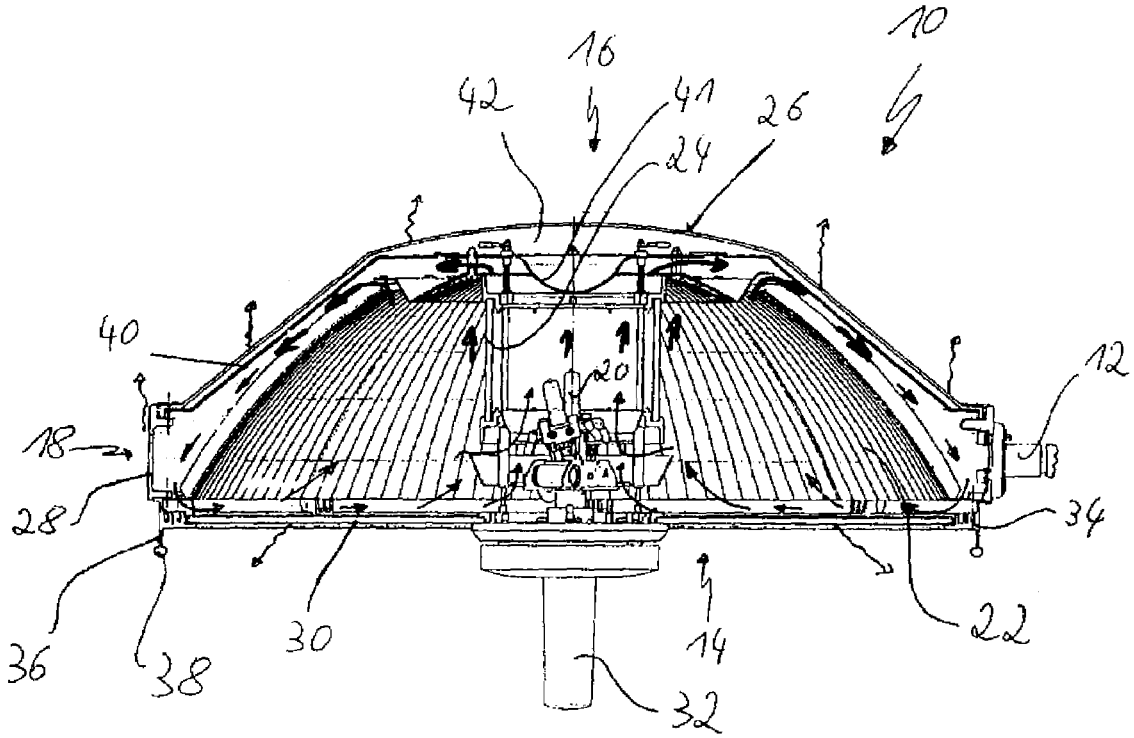

This application claims the benefit of German Patent Application No. 10 2006 014 003.6, filed Mar. 27, 2006. The disclosure of the above application is incorporated herein by reference.

FIELD

The present invention relates to a medical lamp, in particular to an operating theater lamp, comprising a closed lamp housing having a front side, a rear side and a peripheral side connecting the front side and the rear side, with at least one light source and at least one reflector being provided in the lamp housing.

BACKGROUND

The statements in this section merely provide background information related to the present disclosure and may not constitute prior art.

Medical lamps of this type are generally known and have to be flexibly adjustable during a medical examination or a medical intervention in order to ensure an optimum illumination. Furthermore, hygiene plays a decisive role with lamps of this type, i.e. the lamps must be light and easy to clean, on the one hand. On the other hand, it is desirable for the lamps to be optimized with respect to flow engineering, in particular when they are operated under a supply air ceiling which generates a laminar air flow to suppress particle or germ introduction in the region of the operating position.

SUMMARY

It is the object of the invention to provide a medical lamp which is easy to handle and disturbs a laminar air flow as little as possible.

The object is satisfied in that means are provided to reduce the heat dissipation to the outside from the rear side of the housing.

It is ensured, on the one hand, by the solution in accordance with the invention that the lamp can be handled without problem since it does not heat up at its rear side so that medical personnel could not be burned on touching the housing. In addition, the lamp in accordance with the invention ensures that the uplift arising at the housing rear side due to heat generated in the housing is minimized so that a laminar flow above the lamp housing is not negatively influenced.

Advantages embodiments of the invention are described in the description, in the drawing and in the dependent claims.

In accordance with a first advantageous embodiment, the housing can have heat insulation at the inner side on its rear side. The heat dissipation from the rear side of the housing to the outside is reduced in this manner. Such heat insulation can be formed, for example, by provision of insulating material or shielding members.

In accordance with a further advantageous embodiment, the housing can be configured at least sectional on its rear side as a multi-shell housing. A heat insulation is also hereby effected which reduces the heat dissipation to the outside from the rear side of the housing. The heat dissipation from the rear side of the housing to the outside can be reduced by such a multi-shell housing such that the housing has a surface temperature at its rear side of only approximately 30° C.

It can be advantageous for the multi-shell housing to have an outer hood and an inner hood which in particular include a closed air volume. The outer hood of the housing can form its rear side and the inner hood can separate a closed or substantially closed air volume within the housing to reduce the heat dissipation to the outside from the rear side of the housing. It can be advantageous in this connection to form the outer hood of plastic and the inner hood of metal, for example aluminum. Due to the comparatively low heat conductivity, plastic is suitable as the material for the outer hood which can also be manufactured cost-effectively in this case, for example by deep drawing. If the inner hood is made of metal, this improves the electrical shielding of the lamp, on the one hand. On the other hand, the inner hood can then be connected in a heat conductive manner to further components of the lamp which effect a heat dissipation from the lamp or a cooling of the lamp.

The inner hood can thus, for example, be fastened in a heat conductive manner to a ring-shaped case made of metal, in particular of aluminum. The above-described cooling effect is achieved in this manner, on the one hand, and the shielding effect is also thereby improved, on the other hand.

In accordance with a further advantageous embodiment, a component of the lamp not arranged at the rear side of the housing can be configured as cooling rib. A cooling of the lamp is thereby effected without, however, a laminar air flow incident onto the rear side of the lamp housing being disturbed by the heat dissipated from the cooling rib. It can be advantageous in this connection to configure the cooling rib as a gripping rail which is in particular circumferential around 360° and with which the lamp can be put into the desired position by the medical personnel. It is advantageous in this context to arrange the gripping rail on the front side such that it does not project laterally beyond the periphery of the housing. The dissipation of heat in the direction of the rear side of the lamp is hereby optimized.

A particularly cost-effective manufacture is possible if the case and/or the cooling rib is/are configured as an extruded section bent to form a circular ring. Furthermore, the cooling rib can have a web-like section, viewed in cross-section, at whose end a bead-like widened portion is provided. A peripheral, thickened rim is provided by the widened portion in this manner which can be gripped particularly easily.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 is a sectional view of a medical lamp.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows as an example for a medical lamp an operating theater lamp 10 which is pivotably fastened to a carrying arm 12 not shown in more detail. The lamp has a closed housing without air inlet openings or air outlet openings which has a front side 14, a rear side 16 and a peripheral side 18 connecting the front side 14 to the rear side 16. A plurality of light sources 20 are provided at the interior of the lamp and illuminate an operating field via a parabolic reflector 22. The light sources are adjustable inside the lamp in a known manner such that a focusing and a size setting of the light field can be effected. The reference numeral 24 designates a heat filter.

The housing of the operating theater lamp 10 includes an outer hood 26 made of deep-drawn plastic and connected to a ring-shaped case 28 which forms the peripheral wall of the lamp. The housing is formed at the front side 14 of the lamp by a transparent glass plate 30 at whose center a handle 32 is arranged with which the light field size can be varied in a known manner. Finally, the housing of the operating theater lamp 10 has a likewise ring-shaped extruded section of aluminum, which is made as a cooling rib 34, as a connection element between the glass plate 30 and the case 28. The cooling rib 34 runs around 360° and has a web-shaped section 36 which extends vertically downwardly, i.e. parallel to the handle 32 and at whose end or lower side a bead-like widened portion 38 is provided.

The cooling rib 34, which is arranged at the front side 14 of the lamp case 28 and which does not extend radially beyond the outer extent of the case 28 or of the extruded section, serves for the reduction of the heat dissipation from the rear side 16 of the housing to the outside, on the one hand. As a further means for the reduction of the heat dissipation from the rear side of the housing, the latter is configured in multi-shell form in the region of the outer hood 26 and in two-shell form in the specifically shown embodiment. For this purpose, a second, inner hood 40 is provided at the interior of the housing, said inner hood being made of aluminum and including a closed air volume 42 between the outer hood 26 and the inner hood 40.

The inner hood 40 is connected in a heat conductive manner at its lower peripheral rim to the extruded section 28. A thin air gap is formed between the inner hood 40 and the outer hood 26, said air gap extending over the total periphery of the outer hood 26 and only expanding a little in the medium region of the lamp in which the outer hood 26 has a slightly convex arch. As FIG. 1 further shows, parts of the reflector 22 are fastened to the inner hood 40.

The heat flow developing during the operation of the lamp is indicated with arrows in FIG. 1, with high temperatures being provided with thick arrows and lower temperatures being provided with thin arrows. The heat dissipation from the outer side of the housing by means of convection is indicated with thin, snaking arrows. As can be recognized, the light source 20 arranged in the lamp body generates heat which rises upwardly at the interior of the reflector and is redirected outwardly by the inner hood 40. To achieve an ideal redirection, the inner hood 40 has a bell-shaped redirection element 41 above the light source 20, with the concave recess of said redirection element being directed in the direction of the rear of the light source 20. Unwanted turbulences in the interior of the lamp are thereby prevented.

The hot air flow inside the lamp housing, which is directed radially outwardly by the redirection element 41, subsequently flows along the inner side of the inner hood 40 in the direction of the extruded section 28. The already cooling air subsequently flows over the peripheral cooling rib 34 and cools further down in doing so. The air subsequently flows over passage openings into the interior of the reflector 22 and there in the direction of the light source 20 due to the heat flow this produces.

As FIG. 1 further illustrates, the air volume 42 forms a heat insulation between the outer hood 26 and the inner hood 40 so that the heat dissipated from the rear side 16 of the housing is only low and a temperature is adopted at the rear side 16 of the housing of only approximately 30° C.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMBER LIST

10 operating theater lamp
12 carrying arm
14 front side
16 rear side
18 peripheral side
20 light source
22 reflector
24 heat filter
26 outer hood
28 case
30 glass plate
32 handle
34 cooling rib
36 web
38 widened portion
40 inner hood
41 redirection element
42 air volume

What is claimed is:

1. A medical lamp, in particular an operating theater lamp, comprising:

a closed housing having a front side, a rear side and a peripheral side connecting the front side and the rear side, in which at least one light source and at least one reflector are provided, the closed housing configured at least sectionally as a multi-shell housing at the rear side of the closed housing; and means for reducing the heat transmission to the outside from the rear side of the housing, wherein the housing has a heat insulation at an inner side of said rear side of said closed housing.

2. A medical lamp, in particular an operating theater lamp, comprising:

a closed housing having a front side, a rear side and a peripheral side connecting the front side and the rear side, in which at least one light source and at least one reflector are provided, the closed housing configured at least sectionally as a multi-shell housing at the rear side of the closed housing; and means for reducing the heat transmission to the outside from the rear side of the housing, wherein the multi-shell housing has an outer hood and an inner hood, which in particular enclose a closed air volume.

3. A medical lamp in accordance with claim 2, wherein the outer hood is manufactured from plastic and the inner hood is manufactured from metal, in particular aluminum.

4. A medical lamp, in particular an operating theater lamp, comprising:

a closed air housing having a front side, a rear side and a peripheral side connecting the front side and the rear side, in which at least one light source and at least one reflector are provided;

the housing having a component at the front side distal from the rear side of the housing formed as a cooling rib; and means for reducing the heat transmission to the outside from the rear side of the housing.

5. A medical lamp in accordance with claim 4, wherein the cooling rib is made as a gripping rail in particular peripheral around 360°.

6. A medical lamp in accordance with claim 4, wherein the cooling rib is made as an extruded profile.

7. A medical lamp in accordance with claim 4, wherein the component has a web-shaped section, viewed in cross-section, at whose end a bead-like widened portion is provided.

* * * * *